US006047649A

United States Patent [19]

Kuukkanen et al.

[11] Patent Number: 6,047,649

[45] **Date of Patent: *Apr. 11, 2000**

[54] METHOD AND ARRANGEMENT IN COOLING MEDIUM CIRCULATION OF A RECOVERY BOILER

[75] Inventors: Kari Kuukkanen, Nokia; Jussi Mäntyniemi, Tampere, both of Finland

[73] Assignee: Tampella Power Oy, Tampere, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,575

[22] Filed: Mar. 19, 1996

[30] Foreign Application Priority Data

Mar. 22, 1995 [FI] Finland ..... 951362

[51] Int. Cl.[7] ..... F23G 7/04

[52] U.S. Cl. ..... 110/346; 110/234; 110/238; 162/47

[58] Field of Search ..... 110/234, 238, 110/346; 162/29, 30.1, 47, 375; 122/7 R

[56] References Cited

U.S. PATENT DOCUMENTS

| | | | |
|---|---|---|---|
| 2,249,587 | 7/1941 | Tilghman et al. . | |
| 2,279,548 | 4/1942 | Bailey . | |
| 3,088,494 | 5/1963 | Koch et al. . | |
| 5,007,354 | 4/1991 | Uppstu . | |
| 5,478,440 | 12/1995 | Paju | 110/238 X |
| 5,603,803 | 2/1997 | Raak | 110/238 X |

FOREIGN PATENT DOCUMENTS

| | | |
|---|---|---|
| 0 503 116 A1 | of 1992 | European Pat. Off. . |
| 1 938 221 | of 1971 | Germany . |
| 2 007 340 | 5/1979 | United Kingdom . |
| WO 92/18807 | of 1992 | WIPO . |
| WO 94/09206 | 4/1994 | WIPO . |

*Primary Examiner*—Henry A. Bennett
*Assistant Examiner*—Susanne C. Tinker
*Attorney, Agent, or Firm*—Pollock, Vande, Sande & Amernick

[57] ABSTRACT

The object of the present invention is a method in cooling medium circulation, whereby the recovery boiler comprises a furnace limited by wall tubes provided with cooling medium circulation and substantially horizontal floor tubes; a supply system for combustion air; and a supply system for black liquor, whereby a so-called smelt layer is formed in a combustion process on the floor composed of the floor tubes. At least in some of the floor tubes, at least on a section of their length, is arranged a longitudinal flow—particularly a spiral flow—for mixing the liquid and steam phases of the cooling medium.

7 Claims, 2 Drawing Sheets

METHOD AND ARRANGEMENT IN COOLING MEDIUM CIRCULATION OF A RECOVERY BOILER

FIELD OF THE INVENTION

The invention relates to a method in cooling medium circulation of a recovery boiler including, a furnace limited by wall tubes provided with cooling medium circulation and substantially horizontal floor tubes; a supply system for combustion air; and a supply system for black liquor, wherein a so-called smelt layer is formed in a combustion process on the floor composed of the floor tubes.

BACKGROUND OF THE INVENTION

It is known that a recovery boiler is used in the cellulose cooking process for recovering chemicals used in the cellulose cooking process and to produce steam for various phases in the process. After the cellulose cooking process, the spent cooking liquor, so-called black liquor, is separated from chemical pulp and led through an evaporation plant to be combusted in the recovery boiler. In the black liquor combustion process, the black liquor drops dry and the organic substance in it is burned. The remaining residue falls onto the floor of the furnace in the recovery boiler developing a so-called smelt layer, which has a conical shape. Combustion takes place in the smelt layer as well. From the smelt layer the smelt material is led to a dissolving tank. The wall tubes, as well as the floor tubes which constitute the floor of the recovery boiler, are most commonly made of fin tubes, which are connected together by welding to constitute planar constructions. Inside the tubes there is a cooling medium circulation, which is substantially a water-steam circulation.

The floor tubes constituting the floor of the recovery boiler are most commonly horizontally slightly inclined, so that a steam film would not develop inside the tube, but the cooling medium would flow steadily inside the tubes. The angle of inclination varies, the maximum angle being about 10°. During the combustion process, the lowermost section of the smelt layer in the recovery boiler is solidified and thereby functions as an insulator protecting the floor tubes from excessively high temperatures.

The smelt on the floor of the recovery boiler is extremely corrosive. Furthermore, the high temperature of the smelt makes high demands on the material of the floor tubes. Commonly used as the floor tubes of a recovery boiler are compound tubes. A compound tube has a sandwiched wall structure, whereby the outer layer is of austenitic steel and the inner side is of carbon steel. Under normal process conditions, whereby the floor tubes are, on account of proper cooling, covered with solidified smelt material, the outer surface of the floor tube, i.e. the austenitic steel layer, is under compression stress. The reason for this is that austenitic steel has a higher thermal expansion coefficient than carbon steel. The temperature of the floor tubes is normally approximately equal to the temperature of the saturated vapor corresponding to the pressure of the recovery boiler, which on the other hand is dependent on the size and the design pressure of the recovery boiler. As an example could be mentioned a recovery boiler with a design pressure of 84 bar, whereby the temperature of the floor tubes is approximately 310° C.

The floor is an extremely critical element to be designed for a recovery boiler. For one thing this is explained by the fact that if the cooling medium circulation in the floor tubes for some reason is disturbed, the result is that the temperature of the floor tubes rises very fast. Thus the steam developing inside the floor tube forms a layer on the upper part of the floor tube due to the disparity in density between steam and water. If the angle of inclination in relation to the horizontal plane is less than 9° it is possible that the cooling medium circulation is disturbed by comparatively low heat fluxes, e.g. with a flow rate of 1 m/s even 20 kW/m$^2$ causes disturbances.

It is also possible that under certain process conditions the smelt layer on top of the floor tubes constituting the floor becomes very thin or even that the floor of the recovery boiler becomes bare, whereby in this area a high heat flow is suddenly directed to the floor tubes, which causes a high temperature, which is even hundreds of grades higher than under normal process conditions.

When a thermal shock caused by the disturbances presented above,—either internal or external, or both,—is directed to the floor tubes, they fall under a high temperature. Under this condition it is very probable that the compression tension in the floor tube exceeds the yield strength of the floor tube material, i.e. the surface layer of the floor tube is upset. The force induced by compression no longer increases the tension but a permanent deformation results in the floor tube material. Consequently, when the temperature is restored to correspond to the normal process condition, e.g. when the cooling medium circulation is returned to normal, the cooling of the tube does not restore the tensions prevailing in the tube material, but a strong tensile stress prevails in the surface layer of the material and results in cracking of the floor tube.

Cracked floor tubes have to be replaced, because in case the cooling medium, i.e. water, flows into the furnace of the recovery boiler, a smelt explosion will result, damaging the boiler; in the worst case the entire boiler is destroyed and even human lives are lost. Repairs of the floor of a recovery boiler are difficult and expensive measures as the recovery boiler process has to be interrupted, i.e. the recovery boiler has to be run down and the floor has to be cleaned before it is possible to repair the floor tubes.

Furthermore, regarding the prior art, reference is made to WO-publication 92/18807. This publication suggests a power boiler whose vertical wall tube construction is composed of rifled tubes. However, the recovery boiler process differs substantially from the power boiler process. The first distinction relates to the fuel, which in the power boiler process is e.g. carbon. Black liquor is extremely corrosive, and the smelt layer accumulating on the floor of the recovery boiler in the recovery boiler process does not exist in any power boiler using fuel of a different type. On the other hand, power boilers have usually a grate on the bottom of the furnace, which is either a fluidizing grate, a travel grate or the like, depending on the type of the power boiler. Furthermore, the grate of a power boiler usually has openings for the removal of unburnt substance and coarse material whereas the floor of a recovery boiler constitutes an entirely closed construction.

Figure 1:
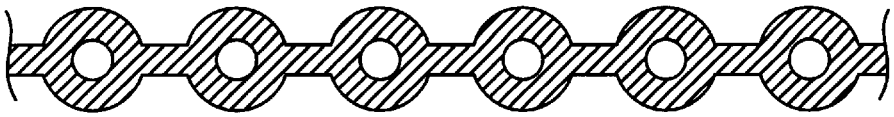
FIG. 1 shows a cross-section of the bottom (floor) tubes of the recovery boiler of this invention.
Figure 2:
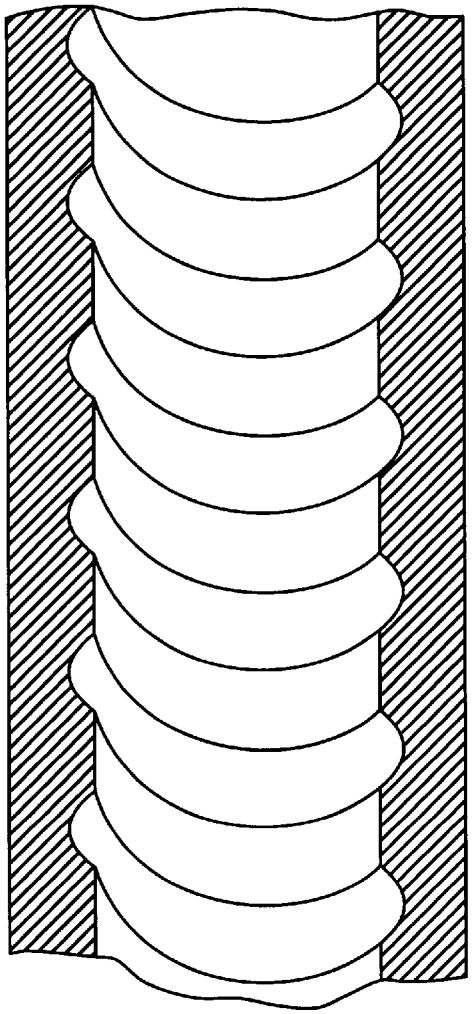
FIG. 2 shows a longitudinal cross-section view of a rifled bottom tube of the invention.
Figure 3:
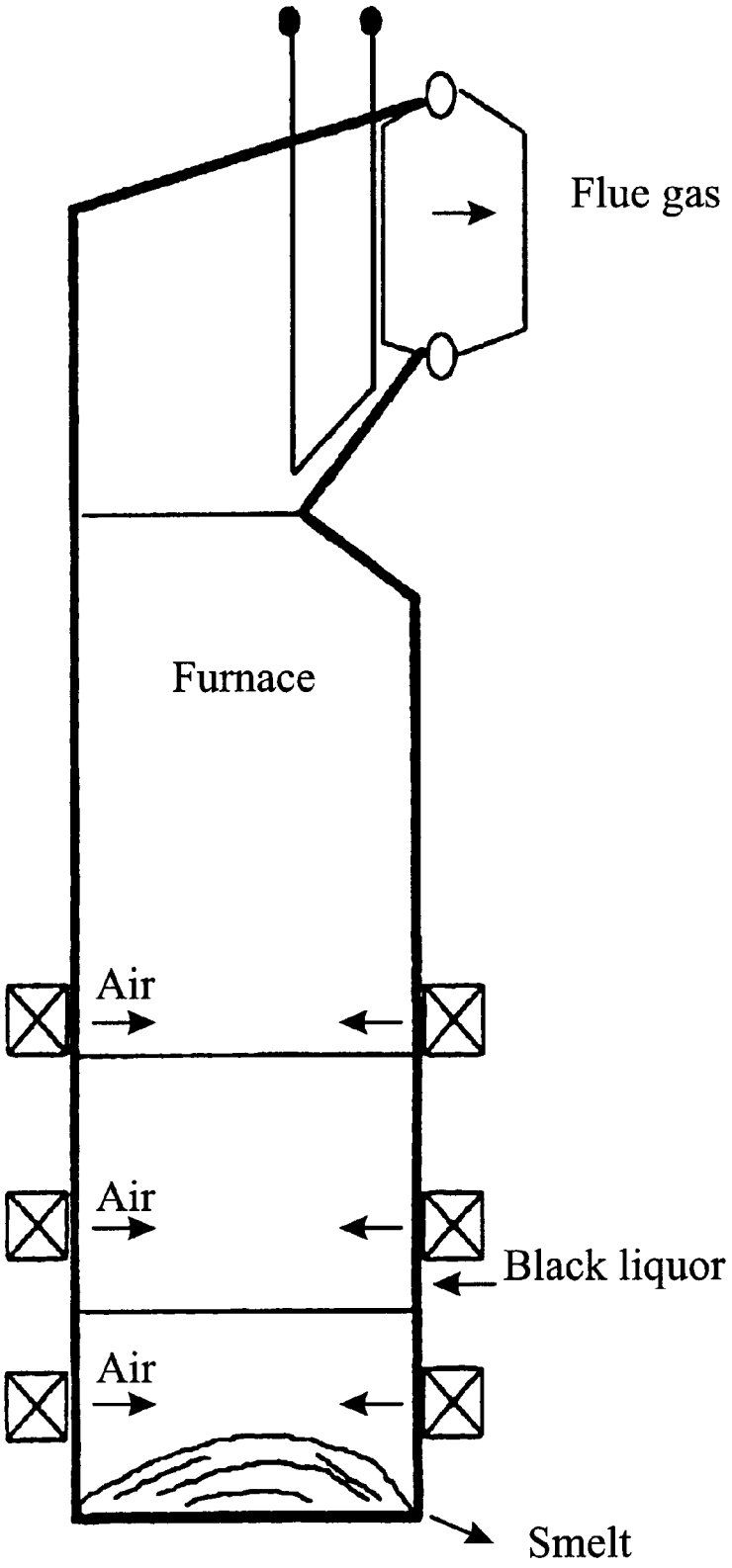
FIG. 3 shows a basic schematic of a recovery boiler of the present invention.

Referring to the facts mentioned hereinabove it is particularly important that the cooling of the floor tubes on the floor of the recovery boiler can be secured as efficiently as possible, whereby potential disturbances in the recovery boiler system can be passed and the cooling can be ensured so that the floor tubes tolerate a disturbance. A purpose of the present invention is to introduce a method for eliminating to a great extent the problems present in the floor constructions of the recovery boilers of prior art, and to secure the cooling of the floor tubes and thus to create a durable and reliable floor for the recovery boiler. For achieving such purposes, the method according to the invention is primarily characterized in that at least in some of the floor tubes, at least on a section of their length, a longitudinal flow is arranged to mix the liquid and steam phases of the cooling medium. As presented above, the cooling medium flows e.g. in a spiral form inside the floor tube, whereby the spiral flow mixes and carries with it the steam which possibly evaporates in the upper part of the floor tube, thus preventing the development of an insulating steam layer. Consequently, the heat transfer from the smelt layer to the heat transfer medium takes place under all conditions with a proper heat-transfer coefficient, whereby sudden increases in the temperature of the floor tubes are avoided if the process conditions potentially vary.

Advantageously, the flow mixing the liquid and steam phases of the cooling medium is a spiral flow, which is created by designing of the inner surface on the floor tubes and/or by feeding the cooling medium into the floor tubes already as a spiral flow.

The invention relates also to a system in the cooling medium circulation of a recovery boiler, including a furnace limited by wall tubes provided with cooling medium circulation and substantially horizontal floor tubes; a supply system for combustion air; and a supply system for black liquor, whereby a so-called smelt layer is formed in a combustion process on the floor composed of the floor tubes. The system is primarily characterized in that at least some of the floor tubes, at least a section of the length of their inner surface, are provided with members for creating a longitudinal spiral flow in the floor tubes. With the present system it is possible to attain the technical advantages in the methods presented hereinabove.

It is advantageous that the members for creating the spiral flow are formed with a rifling made in the inner surface of the floor tubes.

Furthermore, it is advantageous to make the floor tubes of carbon steel or compound see, whose outer layer is of austenitic steel and inner layer of carbon steel.

The floor tubes are advantageously inclined to the maximum of 10° in relation to the horizontal plane.

The floor tubes are made of fin tubes welded together to constitute closed planar constructions.

The invention relates further to the use of rifled or corresponding tubes at least in some of the floor tubes on the floor of the recovery boiler, at least on a section of their length, for creating a longitudinal flow especially a spiral flow—in the floor tubes to mix the liquid and steam phases of the cooling medium.

Constructional solutions in recovery boiler constructions are known as such; thus they are not described closer in this context. Regarding recovery boiler process, reference is made to publication U.S. Pat. No. 5,007,354. It should be noted that the spiral flow may be itensified by feeding the cooling medium into the floor tubes already as a spiral flow.

We claim:

1. A method for circulating cooling medium of a recovery boiler wherein said recovery boiler comprises a furnace limited by wall tubes and substantially horizontal floor tubes, said method comprising the steps of:

circulating cooling medium in said wall tubes and said floor tubes;

supplying combustion air to said recovery boiler;

supplying black liquor to said recovery boiler;

forming a smelt layer on the floor of said boiler composed of said floor tubes due to combustion of said black liquor;

causing longitudinal flow in at least some of the floor tubes at least on a section of their length for mixing a liquid phase and a steam phase of said cooling medium, and using rifled floor tubes at least in some of the floor tubes constituting the floor of the recovery boiler, at least on a section of their length, to create a spiral longitudinal flow in the floor tubes for mixing said liquid phase and said steam phase.

2. A method for circulating cooling medium of a recovery boiler wherein said recovery boiler comprises a furnace limited by wall tubes and substantially horizontal floor tubes, said method comprising the steps of:

circulating cooling medium in said wall tubes and said floor tubes;

supplying combustion air to said recovery boiler;

supplying black liquor to said recovery boiler;

forming a smelt layer on the floor of said boiler composed of said floor tubes due to combustion of said black liquor; and causing longitudinal flow in at least some of the floor tubes at least on a section of their length for mixing a liquid phase and a steam phase of said cooling medium, and wherein said longitudinal flow is spiral longitudinal flow.

3. An apparatus for cooling medium circulation in a recovery boiler, wherein the recovery boiler comprises a furnace limited by wall tubes provided with cooling medium circulation and substantially horizontal floor tubes; a supply system for combustion air; and a supply system for black liquor, whereby a smelt layer is formed from a combustion process on the floor composed of the floor tubes, and wherein the inner surfaces of at least some of the floor tubes, at least on a section of the length of said tubes, are provided with members for creating a longitudinal spiral flow in said floor tubes.

4. An apparatus according to claim 3, wherein said members for creating a longitudinal spiral flow in the floor tubes are made by a rifling in the inner surface of said floor tubes.

5. An apparatus according to claim 3, wherein the floor tubes are of carbon steel or compound steel, whose outer layer is of austenitic steel and inner layer of carbon steel.

6. An apparatus according to claim 3, wherein the floor tubes are inclined to the maximum of 10° in relation to the horizontal plane.

7. An apparatus according to claim 3, wherein the floor tubes are made of fin tubes welded together to form closed planar constructions.

* * * * *